US005990609A

United States Patent [19]

Knox et al.

[11] Patent Number: 5,990,609

[45] Date of Patent: Nov. 23, 1999

[54] DISPLAY DEVICE WITH RESISTIVE ANODES

[75] Inventors: Andrew Ramsay Knox, Kilbirnie; John Beeteson, Skelmorlie, both of United Kingdom

[73] Assignee: International Business Machines Corporation, Armonk, N.Y.

[21] Appl. No.: 08/953,894

[22] Filed: Oct. 20, 1997

[30] Foreign Application Priority Data

Dec. 4, 1996 [GB] United Kingdom ..... 9625235

[51] Int. Cl.[6] ..... H01J 31/12

[52] U.S. Cl. ..... 313/422; 313/497

[58] Field of Search ..... 313/495, 496, 313/497, 422, 431, 491, 492; 315/169.1

[56] References Cited

U.S. PATENT DOCUMENTS

| | | | |
|---|---|---|---|
| 4,339,688 | 7/1982 | Verweel | 313/403 |
| 4,758,728 | 7/1988 | Matey et al. | 250/459.1 |
| 5,747,923 | 5/1998 | Beeteson et al. | 313/431 |
| 5,801,485 | 9/1998 | Van Veen et al. | 313/495 |
| 5,859,508 | 1/1999 | Ge et al. | 313/422 |
| 5,861,712 | 1/1999 | Beetson et al. | 313/442 |

FOREIGN PATENT DOCUMENTS

| | | | |
|---|---|---|---|
| 0205906 | 12/1986 | European Pat. Off. | H01J 31/12 |
| 0381200 | 8/1990 | European Pat. Off. | H01J 31/12 |
| 0398370 | 11/1990 | European Pat. Off. . | |
| 0550103 | 12/1992 | European Pat. Off. | H01J 31/12 |
| 0660367 | 6/1995 | European Pat. Off. | H01J 31/12 |
| 2314201 | 6/1996 | United Kingdom | H01J 31/12 |
| 2304981 | 3/1997 | United Kingdom | H01J 3/02 |
| 2304987 | 3/1997 | United Kingdom | H01J 31/12 |
| 9316483 | 2/1993 | WIPO | H01J 29/58 |
| 9708730 | 3/1997 | WIPO | H01J 31/12 |

*Primary Examiner*—Michael Day
*Attorney, Agent, or Firm*—Martin J. McKinley

[57] ABSTRACT

A display device includes a cathode for emitting electrons and a permanent magnet. A two dimensional array of channels extends between opposite poles of the magnet. The magnet generates, in each channel, a magnetic field for forming electrons from the cathode into an electron beam. A screen receives an electron beam from each channel. The screen has a phosphor coating facing the side of the magnet remote from the cathode. The phosphor coating comprises a plurality of pixels each corresponding to a different channel. A grid electrode is disposed between the cathode and the magnet for controlling flow of electrons from the cathode into each channel. A deflection sequentially addresses the electron beam from each channel to each pixel of the corresponding group. Rotational alignment APPARATUS aligns electron beams from the channels with corresponding pixels of the phosphor coating. The rotational alignment comprises a resistive deflector and apparatus for generating a differential voltage across one or more elements of the deflector. The magnitude and direction of the differential voltage across one or more elements of the deflector is used to provide rotational alignment.

9 Claims, 10 Drawing Sheets

DISPLAY DEVICE WITH RESISTIVE ANODES

FIELD OF THE INVENTION

The present invention relates to a magnetic matrix display device and more particularly to a method of and a means for rotational alignment of electron beams from the channels in a magnetic matrix display device with corresponding pixels of a phosphor coating.

BACKGROUND OF THE INVENTION

A magnetic matrix display of the present invention is particularly although not exclusively useful in flat panel display applications such as television receivers and visual display units for computers, especially although not exclusively portable computers, personal organisers, communications equipment, and the like.

Conventional flat panel displays, such as liquid crystal display panels, and field emission displays, are complicated to manufacture because they each involve a relatively high level of semiconductor fabrication, delicate materials, and high tolerances.

SUMMARY OF THE INVENTION

In accordance with the present invention, there is now provided a display device comprising: cathode means for emitting electrons; a permanent magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating facing the side of the magnet remote from the cathode, the phosphor coating comprising a plurality of pixels each corresponding to a different channel; grid electrode means disposed between the cathode means and the magnet for controlling flow of electrons from the cathode means into each channel; deflection means for sequentially addressing the electron beam from each channel to each pixel of the corresponding group; and rotational alignment means for aligning electron beams from the channels with corresponding pixels of the phosphor coating.

The rotational alignment means preferably comprises a resistive deflection means and means for generating a differential voltage across one or more elements of the deflection means. The magnitude and polarity of the differential voltage across one or more elements of the deflection means is preferably adjustable.

In preferred embodiments of the present invention, each pixel comprises a plurality of different colour sub-pixels, and wherein the rotational alignment means comprises a plurality of anode means each disposed on the surface of the magnet remote from the cathode, each corresponding to a different channel, and each comprising a first and second anode respectively extending along opposite sides of the corresponding channel for accelerating electrons through the corresponding channel and for sequentially addressing electrons emerging from the corresponding channel to different sub-pixels of the corresponding pixel, the first and second anodes associated with each channel being resistive and having a differential voltage applied across each of the first and second anodes, the differential voltages being symmetrical and opposite in sense.

In a preferred embodiment, a beam indexing voltage is applied to the first and second anodes so as to sequentially address electrons emerging from the channels to different ones of the phosphors for the phosphor coating thereby to produce a colour image on the screen.

The resistive deflection means is preferably metal film. The resistive material is preferably deposited by means of photo screen printing. Alternatively, the resistive material may be deposited by means of thin layer electroless deposition.

In preferred embodiments of the present invention, there is provided means for dynamically varying a DC level applied to the anode means to align electrons emerging from the channels with the phosphor coating on the screen.

The present invention extends to a computer system comprising: memory means; data transfer means for transferring data to and from the memory means; processor means for processing data stored in the memory means; and a display device as hereinbefore described for displaying data processed by the processor means.

Viewed from another aspect, the invention also provides a method of alignment of a magnet with phosphor stripes on a screen in a display device comprising the steps of: providing a magnet having a two dimensional array of channels extending between opposite poles of the magnet; providing a collimated light source; illuminating the phosphor stripes on a screen through the channels in the magnet using the collimated light source; and aligning the two dimensional array of channels with the phosphor stripes.

Preferably the collimated light source is a laser light source. In a preferred embodiment, the channels in the magnet through which the collimated light source illuminates the phosphor stripes are channels dedicated for alignment purposes. In an alternative embodiment, the channels in the magnet through which the collimated light source illuminates the phosphor stripes are channels used in the display device for forming electrons from the cathode means into an electron beam.

BRIEF DESCRIPTION OF THE DRAWINGS

Preferred embodiments of the present invention will now be described, by way of example only, with reference to the accompanying drawings in which.

DESCRIPTION OF THE PREFERRED EMBODIMENTS

Figure 1:
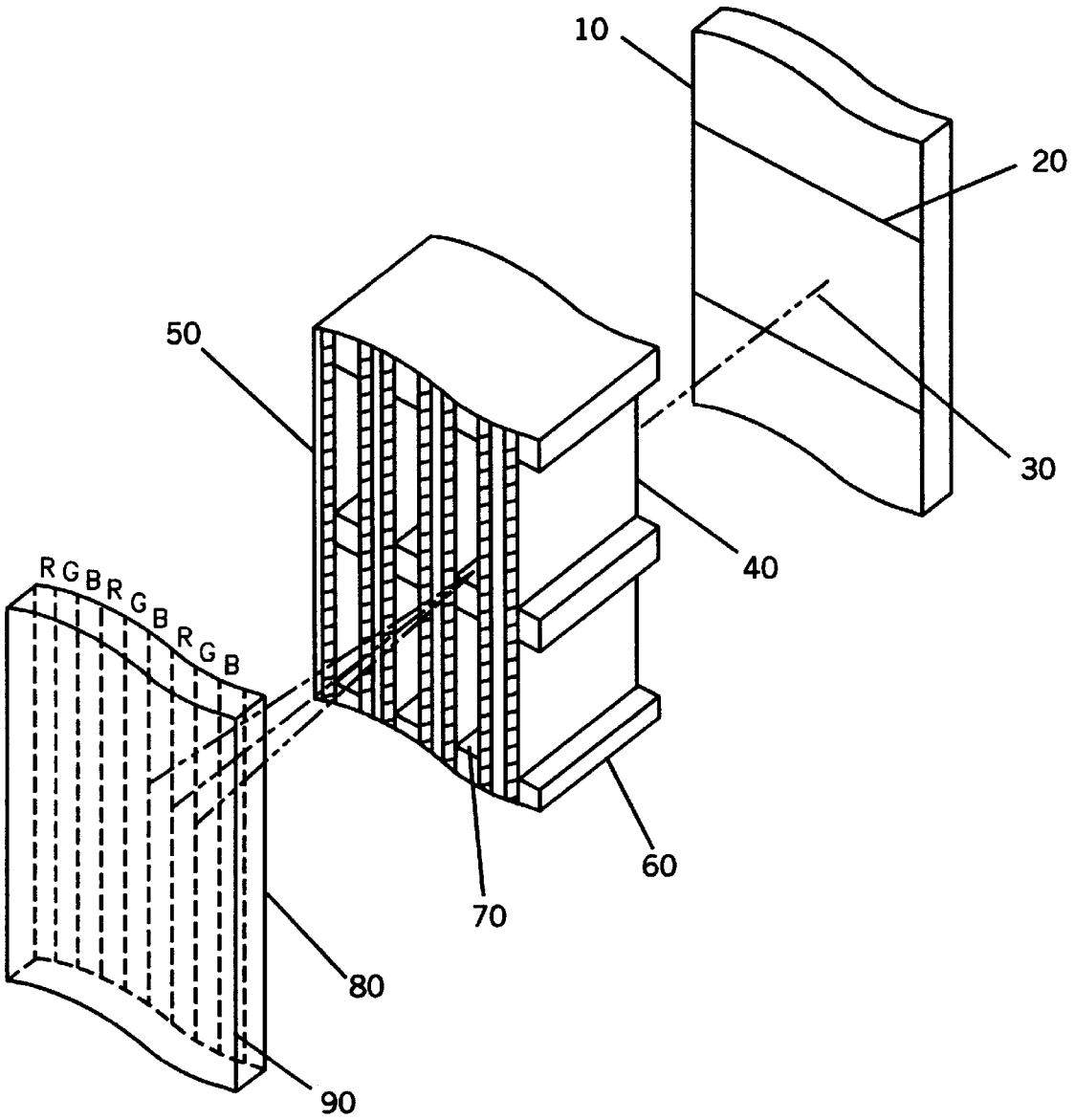
FIG. 1 is an exploded diagram of a display embodying the present invention.

Referring first to FIG. 1, a colour magnetic matrix display of the present invention comprises a first glass plate 10 carrying a cathode 20 and a second glass plate 90 carrying a coating of sequentially arranged red, green and blue phosphor stripes 80 facing the cathode 20. The phosphors are preferably high voltage phosphors. A final anode layer (not shown) is disposed on the phosphor coating 80. A permanent magnet 60 is disposed between glass plates 90 and 10. The magnet is perforated by a two dimension matrix of perforations or "pixel wells" 70. An array of anodes 50 are formed on the surface of the magnet 60 facing the phosphors 80. For the purposes of explanation of the operation of the display, this surface will be referred to as the top of the magnet 60. There is a pair of anodes 50 associated with each column of the matrix of pixel wells 70. The anode of each pair extend along opposite sides of the corresponding column of pixel wells 70. A control grid 40 is formed on the surface of the magnet 60 facing the cathode 20. For the purposes of explanation of the operation of the display, this surface will be referred to as the bottom of the magnet 60. The control grid 40 comprises a first group of parallel control grid conductors extending across the magnet surface in a column direction and a second group of parallel control grid conductors extending across the magnet surface in a row direction so that each pixel well 70 is situated at the intersection of different combination of a row grid conductor and a column grid conductor. As will be described later, plates 10 and 90, and magnet 60 are brought together, sealed and then the whole is evacuated. In operation, electrons are released from the cathode and attracted towards control grid 40. Control grid 40 provides a row/column matrix addressing mechanism for selectively admitting electrons to each pixel well 70. Electrons pass through grid 40 into an addressed pixel well 70. In each pixel well 70, there is an intense magnetic field. The pair of anodes 50 at the top of pixel well 70 accelerate the electrons through pixel well 70 and provide selective sideways deflection of the emerging electron beam 30. Electron beam 30 is then accelerated towards a higher voltage anode formed on glass plate 90 to produce a high velocity electron beam 30 having sufficient energy to penetrate the anode and reach the underlying phosphors 80 resulting in light output. The higher voltage anode may typically be held at 10 kV.

What follows is a description of the device physics associated with a display of the present invention, in which the following quantities and equations are used:

Charge on an electron: $1.6\times10^{-19}$C

Energy of 1 electron-volt: $1.6\times10^{-19}$J

Rest mass of 1 electron: $9.108\times10^{-31}$Kg

Electron velocity: $v=(2\ eV/m)^{1/2}$ m/s

Electron kinetic energy: $mv^2/2$

Electron momentum: mv

Cyclotron frequency: f=qB/(2.pi.m) Hz

Figure 2B:
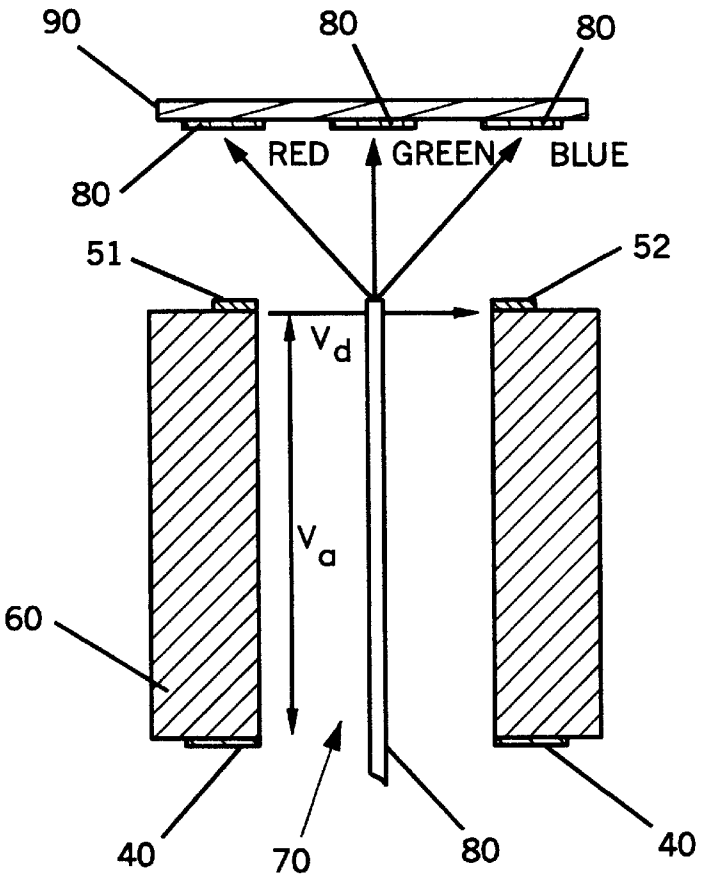
FIG. 2B is a cross-section view through a well of an electron source of a display embodying the present invention to show electric field orientation.
Figure 2A:
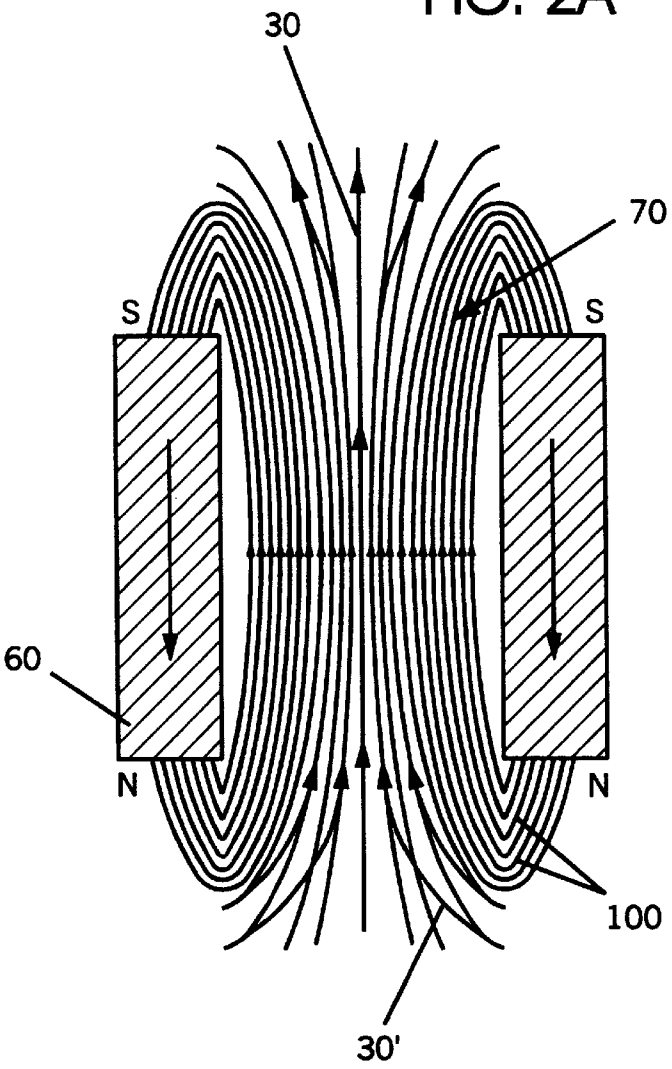
FIG. 2A is a cross-section view through a well of an electron source of a display embodying the present invention to show magnetic field orientation.

FIG. 2A shows a simplified representation of magnetic fields with associated electron trajectories passing though pixel well 70. FIG. 2B shows a representation of electrostatic fields with associated electron trajectories passing through pixel well 70. An electrostatic potential is applied between the top and bottom of magnet 60 which has the effect of attracting electrons through the magnetic field shown at 100. Cathode 20 may be a hot cathode or a field emission tip array or other convenient source of electrons.

At the bottom of the magnetic field 100, by the entrance to pixel well 70, the electron velocity is relatively low (leV above the cathode work function represents an electron velocity of around $6\times10^5$ m/s). Electrons 30' in this region can be considered as forming a cloud, with each electron travelling in its own random direction. As the electrons are attracted by the electrostatic field their vertical velocity increases. If an electron is moving in exactly the same direction as the magnetic field 100 there will be no lateral force exerted upon it. The electron will therefore rise through the vacuum following the electric field lines. However, in the more general case the electron direction will not be in the direction of the magnetic field.

Referring now to FIG. 2B, magnetic force acting on a moving electron is perpendicular to both the magnetic field and the velocity of the electron (Flemings right hand rule or $F=e(E+v\times B)$). Thus, in the case of a uniform magnetic field only, the electron will describe a circular path. However, when the electron is also being accelerated by an electric field, the path becomes helical with the diameter of the helix being controlled by the magnetic field strength and the electrons x,y velocity. The periodicity of the helix is controlled by the electrons vertical velocity. A good analogy of this behaviour is that of a cork in a whirlpool or dust in a tornado.

By way of summary, electrons enter magnetic field B 100 at the bottom of magnet 60, accelerate through well 70 in magnet 60, and emerge at the top of magnet 60 in a narrow but diverging beam.

Considering now the display as whole rather than a single pixel, the magnetic field B 100 shown in FIG. 2A is formed by a channel or pixel well 70 through a permanent magnet 60. Each pixel requires a separate pixel well 70. Magnet 60 is the size of the display area and is perforated by a plurality of pixel wells 70.

Figure 3:
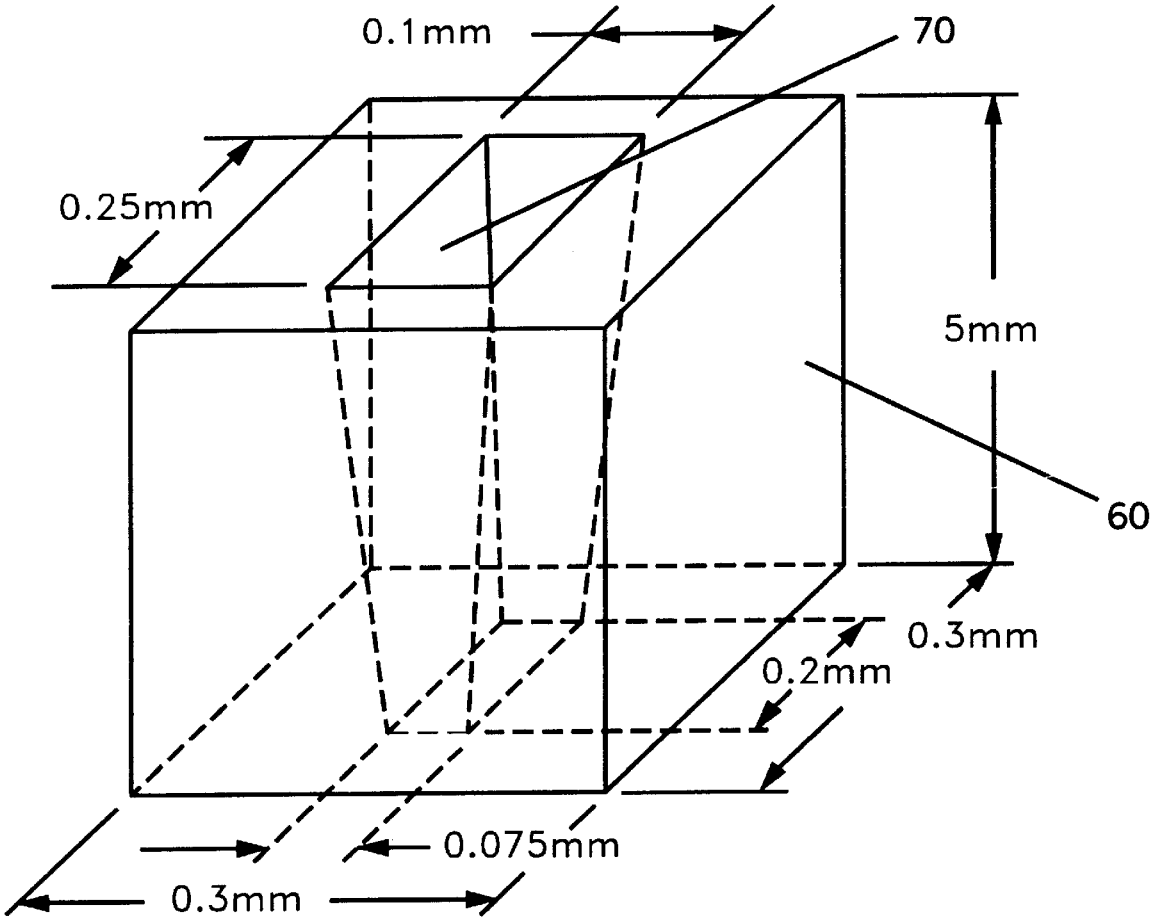
FIG. 3 is an isometric view of a well of an electron source of a display embodying the present invention.

Referring now to FIG. 3, the magnetic field intensity in well 70 is relatively high; the only path for the flux lines to close is either at the edge of magnet 60 or through wells 70. Wells 70 may be tapered, with the narrow end of the taper adjacent cathode 20. It is in this region that the magnetic field is strongest and the electron velocity lowest. Thus efficient electron collection is obtained.

Figure 4B:
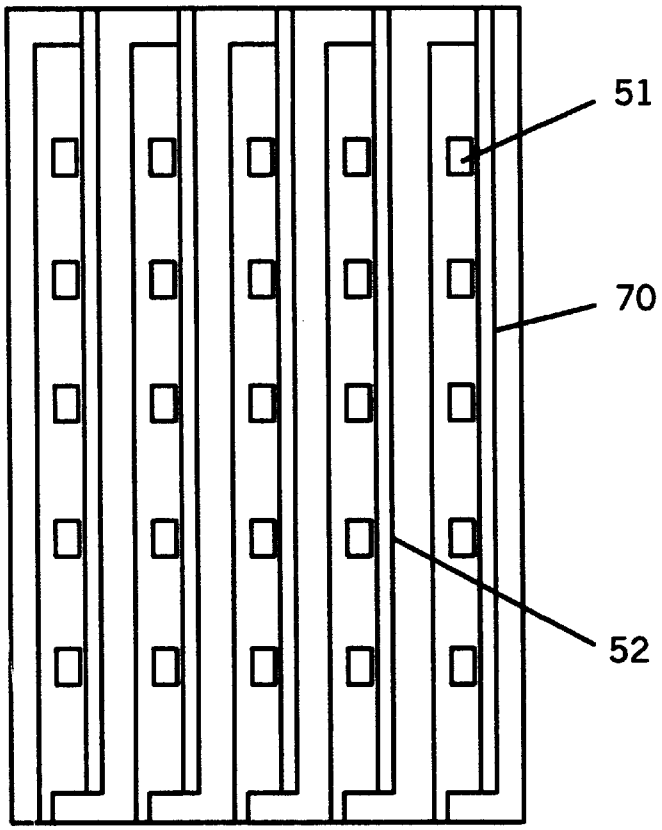
FIG. 4B is a plan view of a plurality of wells of an electron source of a display embodying the present invention.
Figure 4A:
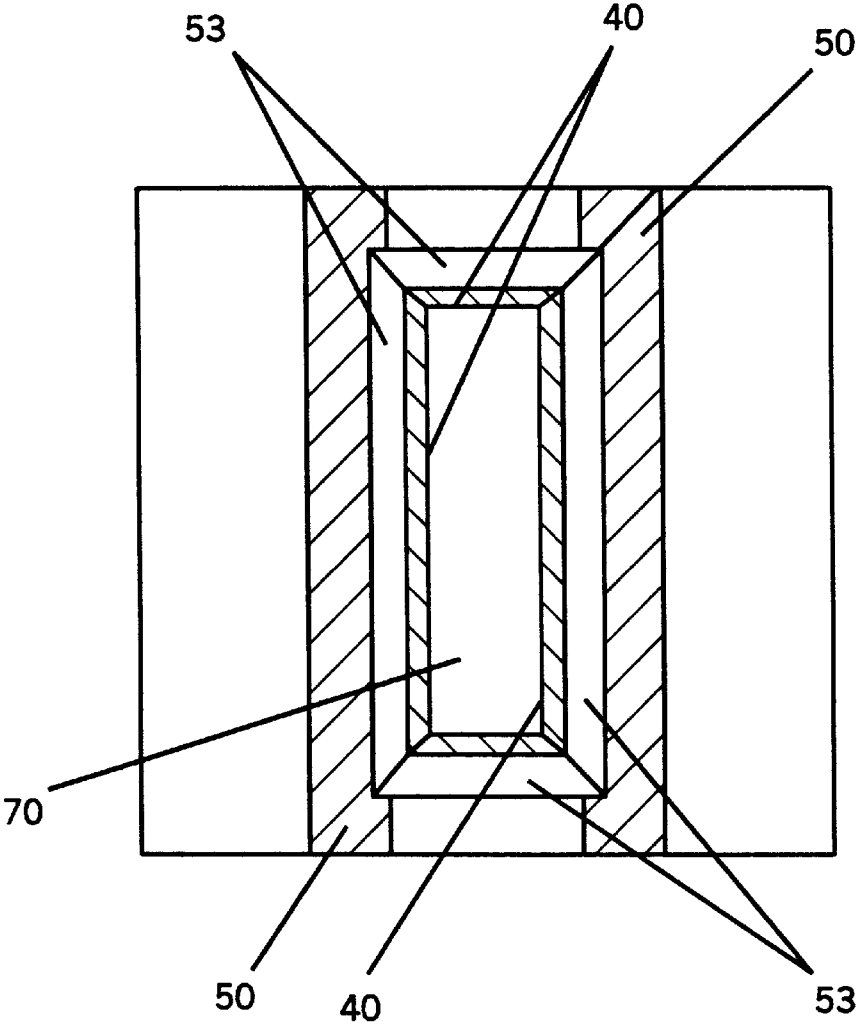
FIG. 4A is a plan view of a well of an electron source of a display embodying the present invention.

Referring back to FIG. 2B, electron beam 30 is shown entering an electrostatic field E. As an electron in the beam moves through the field, it gains velocity and momentum. The significance of this increase in the electrons momentum will be discussed shortly. When the electron nears the top of magnet 60, it enters a region influenced by deflection anodes 50. Assuming, for the purpose of discussion only, an anode voltage of 1 kv and a cathode voltage of 0 V, the electron velocity at this point is $1.875\times10^7$ m/s or approximately 6% of the speed of light. At the final anode, where the electron velocity is $5.93\times10^7$ m/s or 0.2c, since the electron has then moved through 10 kv. Anodes 51 and 52 on either side of the exit from the pixel well 70 may be individually controlled. Referring now to FIGS. 4A and 4B, anodes 51 and 52 are preferably arranged in a comb configuration in the interests of easing fabrication. Anodes 51 and 52 are separated from well 70 and grid 40 by insulating regions 53. There are four possible states for anodes 51 and 52, as follows.

1. Anode 51 is OFF; Anode 52 is OFF: In this case there is no accelerating voltage $V_a$ between the cathode 20 and the anodes 51 and 52. This state is not used in normal operation of the display.
2. Anode 51 is ON; Anode 52 is ON: In this case there is accelerating voltage $V_a$ symmetrically about the electron beam. The electron beam path is unchanged. When leaving the control anode region the electrons continue until they strike the Green phosphor.
3. Anode 51 is OFF; Anode 52 is ON: In this case there is an asymmetrical control anode voltage $V_d$. The electrons are attracted towards the energised anode 52 (which is still providing an accelerating voltage relative to the cathode 20). The electrons beam is thus electrostatically deflected towards the Blue phosphor.
4. Anode 51 is ON; Anode 52 is OFF: This is the opposite to 3. above. In this case, the electron beam is deflected towards the Red phosphor.

It will be appreciated that other sequences of phosphors may be deposited on the screen with corresponding data re-ordering.

It should also be appreciated that the above deflection technique does not change the magnitude of the electron energy.

As described above, electron beam 30 is formed as electrons move through magnet 60. The magnetic field B 100, although decreasing in intensity still exists above the magnet and in the region of anodes 50. Thus, operation of anodes 50 also requires that they have sufficient effect to drive electron beam 30 at an angle through magnetic field B 100. The momentum change of the electron between the bottom and top of well 70 is of the order of 32× (for a 1 KV anode voltage). The effect of the divergent magnetic field B 100 may be reduced between the bottom and top by a similar amount.

Individual electrons tend to continue travelling in a straight line. However, there are three forces tending to disperse electron beam 30, as follows:

1. The diverging magnetic field B 100 tends to cause electron beam 30 to diverge due to the $v_{xy}$ distribution;
2. The electrostatic field E tends to deflect electron beam 30 towards itself; and,
3. Space charge effects within beam 30 itself cause some divergence.

Figure 5:
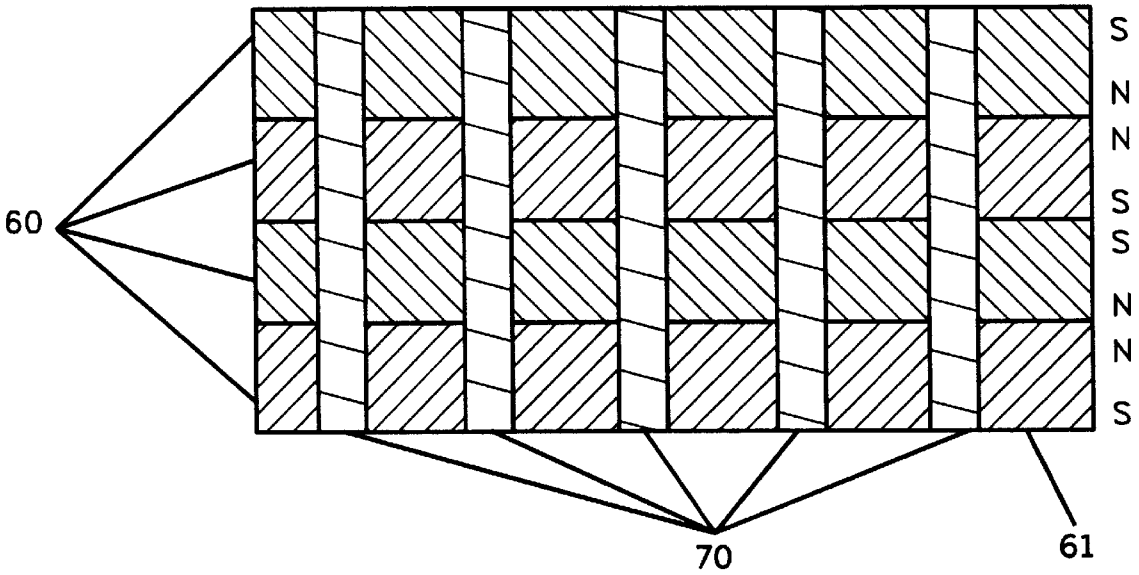
FIG. 5 is a cross section of a stack of magnets of an electron source of a display embodying the present invention.

Referring now to FIG. 5, in a modification to the example of the preferred embodiment of the present invention hereinbefore described, magnet 60 is replaced by a stack 61 of magnets 60 with like poles facing each other. This produces a magnetic lens in each well 70, thereby aiding beam collimation prior to deflection. This provides additional electron beam focusing. Furthermore, providing the stack 61 consists of one or more pairs of magnets, the helical motion of the electrons is cancelled. In some embodiments of the present invention, spacers (not shown) may be inserted between magnets 60 to improve the lens effect of stack 61.

As mentioned earlier, the display has cathode means 20, grid or gate electrodes 40, and an anode. The arrangement can thus be regarded as a triode structure. Electron flow from cathode means 20 is regulated by grid 40 thereby controlling the current flowing to the anode. It should be noted that the brightness of the display does not depend on the velocity of the electrons but on the quantity of electrons striking phosphor 80.

As mentioned above, magnet 60 acts as a substrate onto which the various conductors required to form the triode are deposited. Deflection anodes 50 are deposited on the top face of magnet 60 and control grid 40 is fabricated on the bottom surface of the magnet 60. Referring back to FIG. 3, it will be appreciated that the dimensions of these conductors are relatively large compared with those employed in current flat panel technologies such as liquid crystal or field emission displays for example. The conductors may advantageously be deposited on magnet 60 by conventional screen printing techniques, thereby leading to lower cost manufacture compared with current flat panel technologies.

Referring back to FIG. 4, deflection anodes 50 are placed on either side of well 70. In the example hereinbefore described, an anode thickness of 0.01 mm provided acceptable deflection. However, larger dimensions may be used with lower deflection voltages. Deflection anodes 50 may also be deposited to extend at least partially into pixel well 70. It will be appreciated that, in a monochrome example of a display device of the present invention, anode switching or modulation is not required. The anode width is selected to avoid capacitive effects introducing discernable time delays in anode switching across the display. Another factor affecting anode width is current carrying capacity, which is preferably sufficient that a flash-over does not fuse adjacent anodes together and thus damage the display.

In an embodiment of the present invention preferred for simplicity, beam indexing is implemented by alternately switching drive voltages to deflection anodes 50. Improved performance is obtained in another embodiment of the present invention by imposing a modulation voltage on deflection anodes 50. The modulation voltage waveform can be one of many different shapes. However, a sine wave is preferable to reduce back emf effects due to the presence of the magnetic field.

Cathode means 20 may include an array of field emission tips or field emission sheet emitters (amorphous diamond or silicon for example). In such cases, the control grid 40 may be formed on the field emission device substrate. Alternatively, cathode means 20 may include plasma or hot area cathodes, in which cases control grid 40 may be formed on the bottom surface of the magnet as hereinbefore described. An advantage of the ferrite block magnet is that the ferrite block can act as a carrier and support for all the structures of the display that need precision alignment, and that these structures can be deposited by low grade photolithography or screen printing. In yet another alternative embodiment of the present invention, cathode means 20 comprises a photocathode.

As mentioned above, control grid 40 controls the beam current and hence the brightness. In some embodiments of the present invention, the display may be responsive to digital video alone, ie: pixels either on or off with no grey scale. In such cases, a single grid 40 provides adequate control of beam current. The application of such displays are however limited and, generally, some form of analog, or grey scale, control is desirable. Thus, in other embodiments of the present invention, two grids are provided; one for setting the black level or biassing, and the other for setting the brightness of the individual pixels. Such a double grid arrangement may also perform matrix addressing of pixels where it may be difficult to modulate the cathode.

A display of the present invention differs from a conventional CRT display in that, whereas in a CRT display only one pixel at a time is lit, in a display of the present invention a whole row or column is lit. Another benefit of the display of the present invention resides in the utilisation of row and column drivers. Whereas a typical LCD requires a driver for each of the Red, Green and Blue channels of the display, a display of the present invention uses a single pixel well 70 (and hence grid) for all three colours. Combined with the aforementioned beam-indexing, this means that the driver requirement is reduced by a factor of 3 relative to a comparable LCD. A further advantage is that, in active LCDS, conductive tracks must pass between semiconductor switches fabricated on the screen. Since the tracks do not emit light, their size must be limited so as not to be visible to a user. In displays of the present invention, all tracks are hidden either beneath phosphor 80 or on the underside of magnet 60. Due to the relatively large spaces between adjacent pixel wells 70, the tracks can be made relatively large. Hence capacitance effects can be easily overcome.

The relative efficiencies of phosphors 80 at least partially determines the drive characteristics of the gate structure. One way to reduce the voltages involved in operating a beam indexed system is to change the scanning convention. In a preferred embodiment of the present invention, rather than the usual arrangement of phosphors in the order R G B and a sequential scanning of those phosphors in the order R G B R G B the phosphors are arranged so that the most inefficient phosphor is placed in between the two more efficient phosphors in a phosphor stripe pattern. Thus, if the most inefficient phosphor is, for example, Red, the phosphors are arranged in the order B R G and the phosphors are scanned sequentially in the order B R G R B R G R, that is the beam is indexed to the Blue phosphor, then to the Red one, then to the Green one, then to the Red one again, before returning to the Blue one to start a new sequence.

In a preferred embodiment of the present invention, a standing DC potential difference is introduced across deflection anodes 50. The potential can be varied by potentiometer adjustment to permit correction of any residual misalignment in a single dimension between phosphors 80 and pixel wells 70. A two dimensional misalignment can be compensated by applying a varying modulation as the row scan proceeds from top to bottom.

Figure 6B:
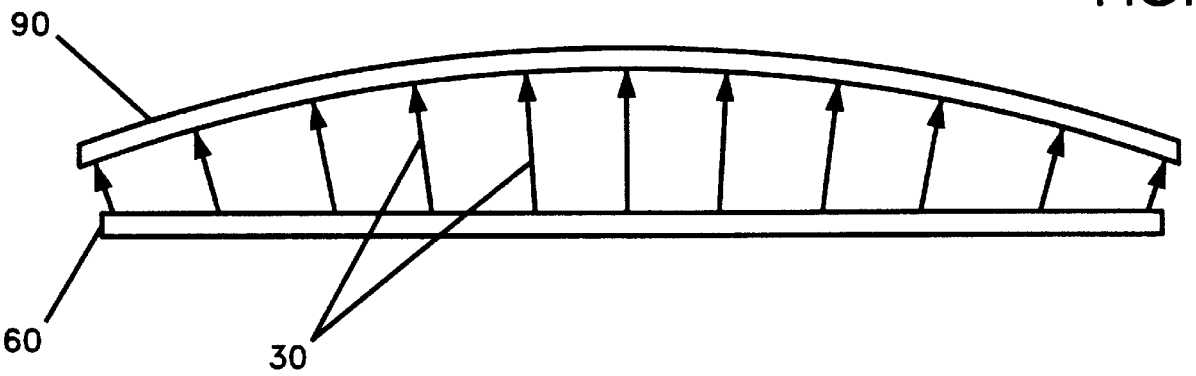
FIG. 6B, is a cross section through the display of FIG. 6A.
Figure 6A:
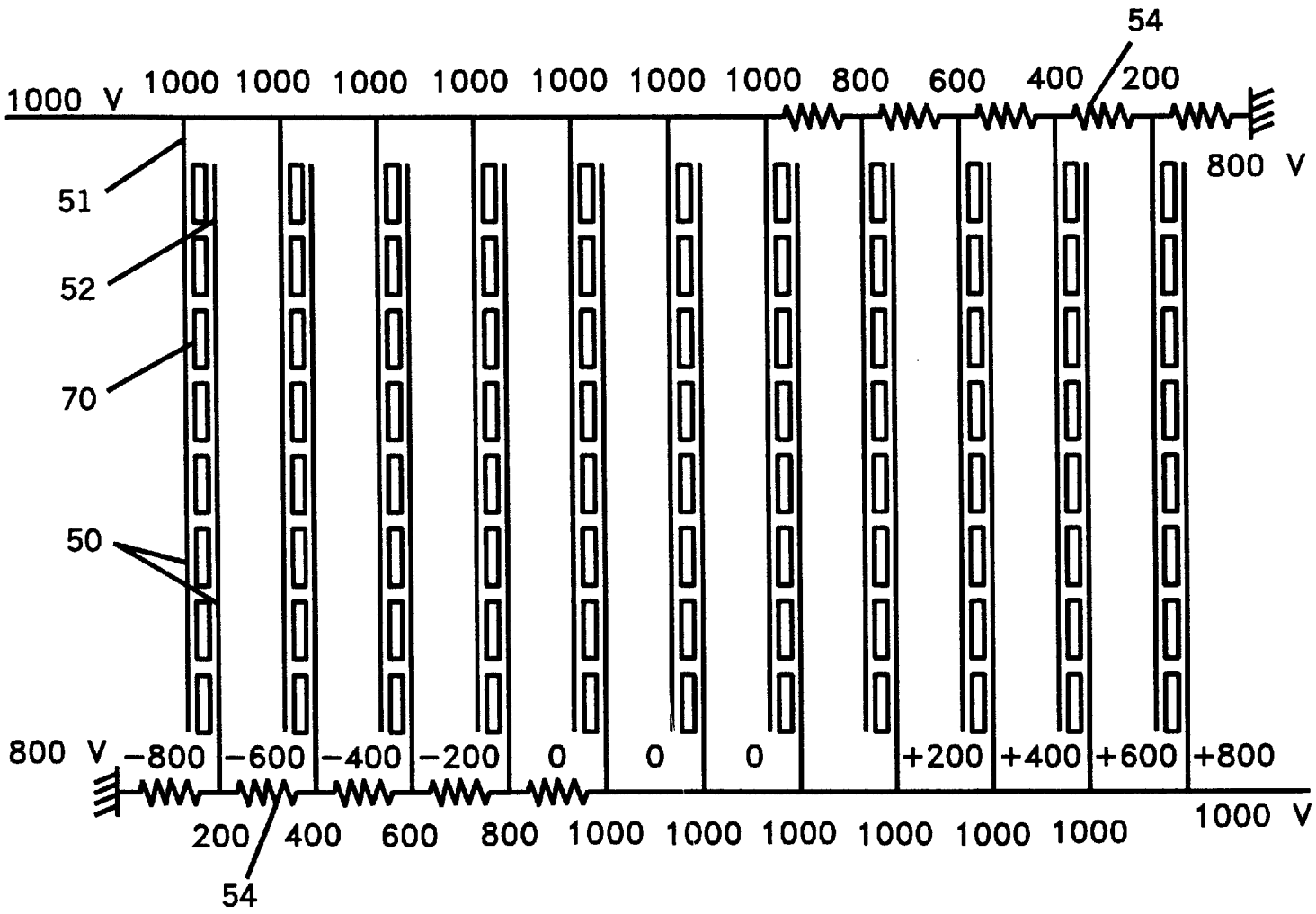
FIG. 6A, is a plan view of a display embodying the present invention.

Referring now to FIG. 6A, in a preferred embodiment of the present invention, connection tracks 54 between deflection anodes 50 are made resistive. This introduces a slightly different DC potential from the centre to the edge of the display. The electron trajectory thus varies gradually in angle as shown in FIG. 6B. This permits a flat magnet 60 to be combined with non-flat glass 90 and, in particular, cylindrical glass. Cylindrical glass is preferable to flat glass because it relieves mechanical stress under atmospheric pressure. Flat screens tend to demand extra implosion protection when used in vacuum tubes.

In a preferred embodiment of the present invention, colour selection is performed by beam indexing. To facilitate such beam indexing, the line rate is 3 times faster than normal and the R, G, and B line is multiplexed sequentially. Alternatively, the frame rate may be 3 times faster than usual and field sequential colour is employed. It should be appreciated that field-sequential scanning may produce objectionable visual effects to an observer moving relative to the display. Important features of a display of the present invention include the following.

1. Each pixel is generated by a single pixel well 70.
2. The colour of a pixel is determined by a relative drive intensity applied to each of the three primary colours.
3. Phosphor 80 is deposited on faceplate 90 in stripes.
4. Primary colours are scanned via a beam index system which is synchronised to the grid control.
5. An electron beam is used to excite high voltage phosphors.
6. Grey-scale is achieved by control of the grid voltage at the bottom of each pixel well (and hence the electron beam density).
7. An entire row or column is addressed simultaneously.
8. If required, the least efficient phosphor 80 can be double scanned to ease grid drive requirements, that is the least efficient phosphor is scanned twice for each time that the other two, more efficient phosphors are scanned.
9. Phosphor 80 is held at a constant DC voltage.

The above features may provide one or more of the following advantages over conventional flat panel displays.

1. The pixel well concept reduces overall complexity of display fabrication.
2. Whereas in a CRT display, only about 11% of the electron beam current exits the shadow mask to excite the phosphor triads, in a display of the present invention the electron beam current at or near to 100% of the beam current is utilised for each phosphor stripe it is directed at by the beam indexing system. An overall beam current utilisation of 33% is achievable, 3 times that achievable in a conventional CRT display.
3. Striped phosphors prevent Moire interference occurring in the direction of the stripes.
4. Control structures and tracks for the beam index system can be easily accommodated in a readily available area on top of the magnet, thereby overcoming a requirement for narrow and precise photolithography as is inherent in conventional LCDs.
5. High voltage phosphors are well understood and readily available.
6. The grid voltage controls an analog system. Thus the effective number of bits for each colour is limited only by the DAC used to drive grid 40. Since only one DAC per pixel well row is involved, and the time available for digital to analog conversion is very long, higher resolution in terms of grey-scale granularity is commercially feasible.

Thus, the generation of "true colour" (24 bits or more) is realisable at relatively low cost. Note that, unlike conventional LCDs, one DAC per pixel row has been chosen, rather than one DAC per pixel column. In this way, with a conventional 4:3 aspect ratio for the display, only 75% of the number of DACs are needed. More simple switches are needed, but these are simpler to fabricate and cheaper.

7. As with conventional LCDs, a display of the present invention uses a row/column addressing technique. Unlike conventional CRT displays however, the excitation time of the phosphor is effectively one third of the line period, eg: between 200 and 530 times longer than that for a CRT display for between 600 and 1600 pixels per line resolution. Even greater ratios are possible, especially at higher resolutions. The reason for this is that line and frame flyback time necessary when considering conventional CRT display are not needed for displays of the present invention. The line flyback time alone for a conventional CRT display is typically 20% of the total line period. Furthermore front and back porch times are redundant in displays of the present invention, thereby leading to additional advantage. Further benefits include:
   a) Only one driver per row/column is required (conventional colour LCDs need three);
   b) Very high light outputs are possible. In a conventional CRT display, the phosphor excitation time is much shorter than it's decay time. This means that only one photon per site is emitted during each frame scan. In a display of the present invention, the excitation time is longer than the decay period and so multiple photons per site are emitted during each scan. Thus, a much greater luminous output can be achieved. This is attractive both for projection applications and for displays to be viewed in direct sunlight.

c) The grid switching speeds are fairly low. It will be appreciated that, in a display of the present invention, the conductors formed on the magnet are operating in a magnetic field. Thus, the conductor inductance gives rise to an unwanted EMF. Reducing the switching speeds reduces the EMF, and also reduces stray magnetic and electric fields.

8. The grid drive voltage is related to the cost of the switching electronics. CMOS switching electronics offers a cheap possibility, but CMOS level signals are also invariably lower than those associated with alternative technologies such as bipolar, for example. Double scanning, eg: splitting the screen in half and scanning the 2 halves in parallel, as is done in LCDs, thus provides an attractively cheap drive technology. Unlike in LCD technology however, double scanning in a display of the present invention doubles the brightness.

9. In low voltage Field Emission Displays (FEDs), phosphor voltages are switched to provide pixel addressing. At small phosphor strip pitches, this technique introduces significant electric field stress between the strips. Medium or higher resolution FEDs may not therefore be possible without risk of electrical breakdown. In displays of the present invention however, the phosphors are held at a single DC final anode voltage as in a conventional CRT display. In preferred embodiments of the present invention, an aluminium backing is placed on the phosphors to prevent charge accumulation and to improve brightness. The electron beams are sufficiently energetic to penetrate the aluminum layer and cause photon emission from the underlying phosphor.

Figure 7:
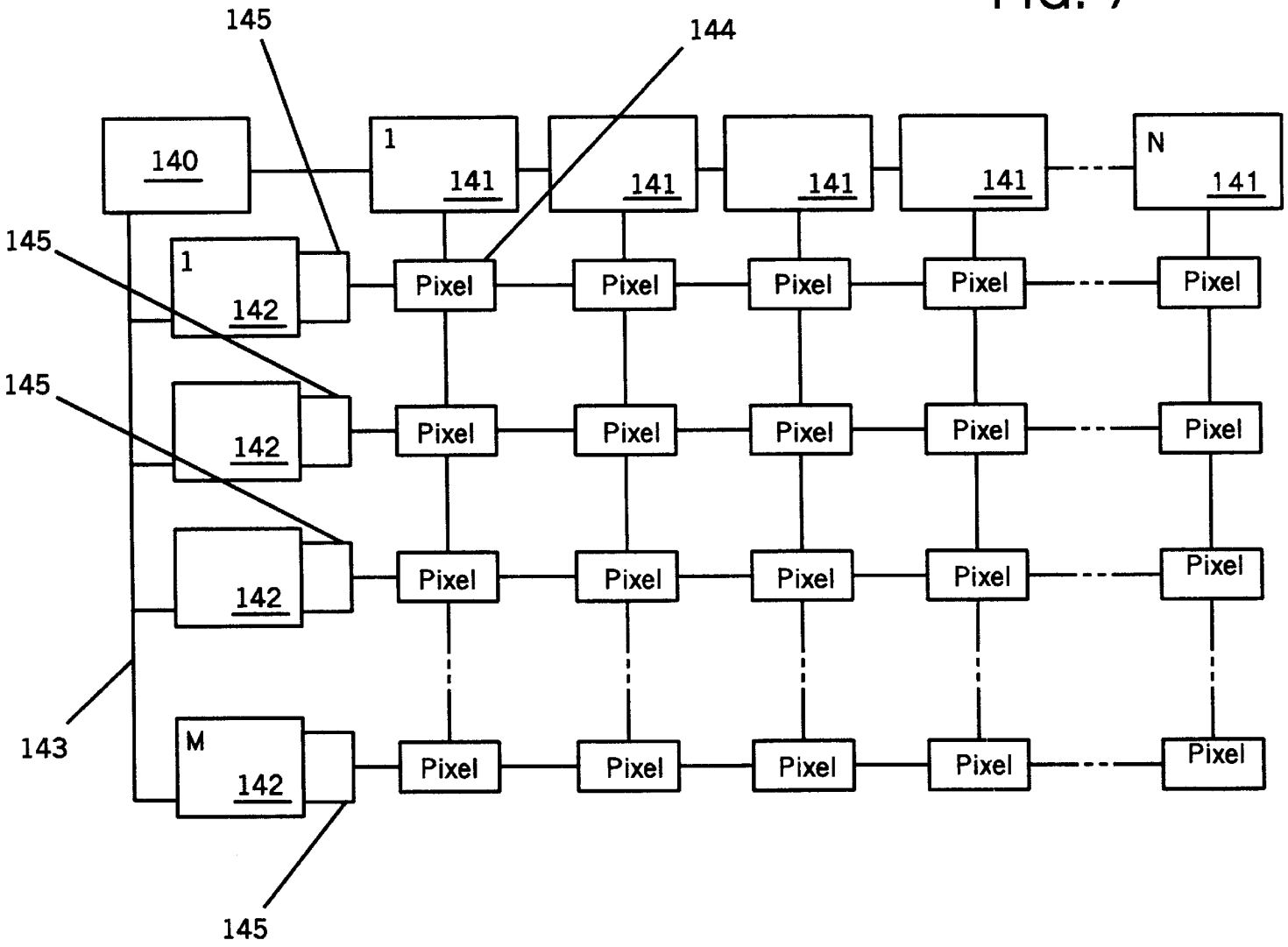
FIG. 7, is a block diagram of an addressing system for a display embodying the present invention.

Referring now to FIG. 7, a preferred matrix addressing system for an N×M pixel display of the present invention comprises an n bit data bus 143. A data bus interface 140 receives input red, green and blue video signals and places them on the data bus in an n bit digital format, where p of each n bits indicates which of the M rows the n bits is addressed to. Each row is provided with an address decoder 142 connected to a q bit DAC 145, where p+q=n. In preferred embodiments of the present invention, q=8. The output of each DAC is connected to a corresponding row conductor of grid 40 associated with a corresponding row of pixels 144. Each column is provided with a column driver 141. The output of each column driver 141 is connected to corresponding column conductor of grid 40 associated with a corresponding column of pixels 144. Each pixel 144 is thus located at the intersection of a different combination of row and column conductors of grid 40.

Figure 8:
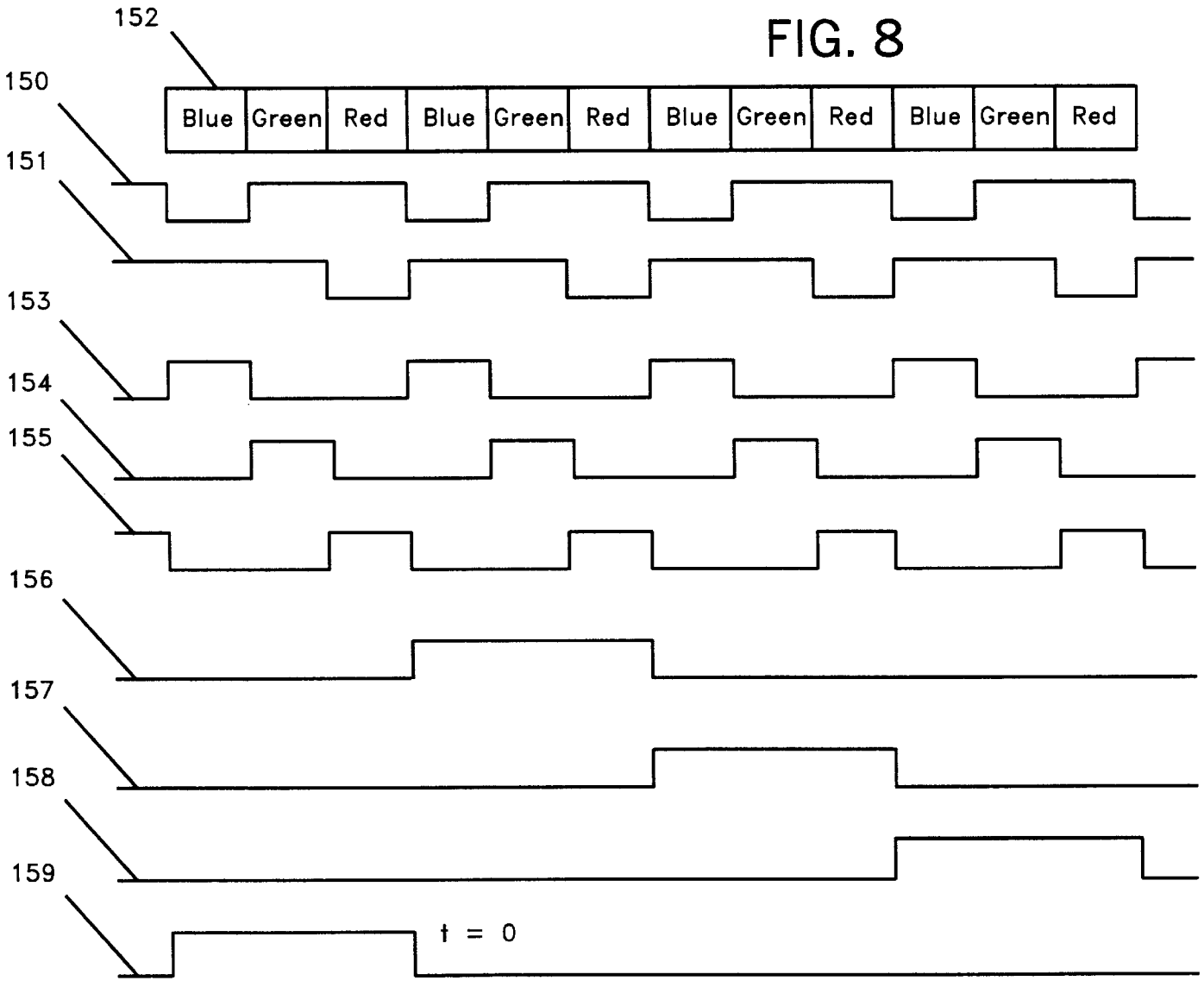
FIG. 8 is a timing diagram corresponding to the addressing system of FIG. 7.

Referring now to FIG. 8, in operation, anodes 51 and 52 are energised with waveforms 150 and 151 respectively to scan electron beam 30 from each pixel well 70 across Red, Green and Blue phosphor stripes 80 in the order shown at 152. Blue, Green and Red video data, represented by waveforms 153, 154, and 155, is sequentially gated onto the row conductors in synchronisation with beam indexing waveforms 150 and 151. Column drivers 1, 2, 3 and N generate waveforms 156, 157, 158, and 159 respectively to sequentially select each successive pixel in given row.

Figure 9:
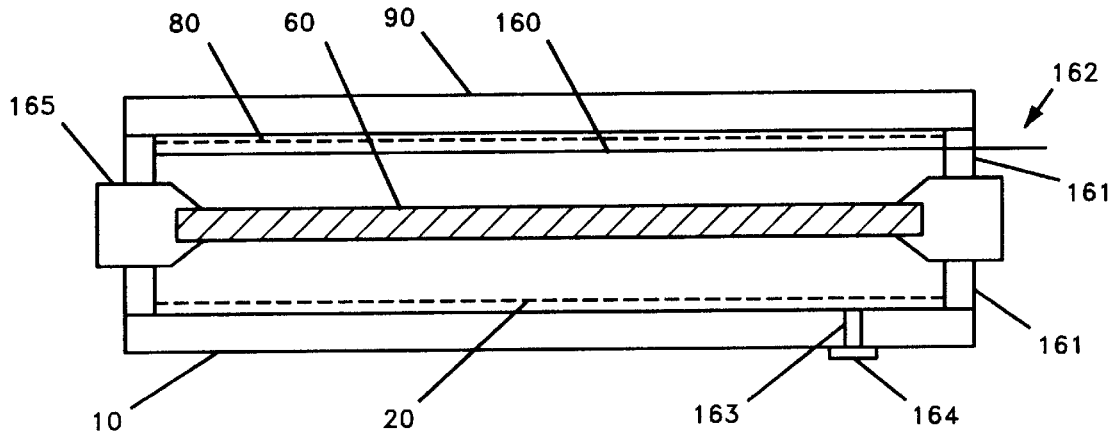
FIG. 9 is a cross section through a display embodying the present invention.

Referring now to FIG. 9, in a preferred embodiment of the present invention in which cathode means 20 is provided by field emission devices. Magnet 60 is supported by glass supports through which connections to the row and column conductors of grid 40 are brought out. A connection 162 to the final anode 160 is brought out via glass side supports 161. The assembly is evacuated during manufacture via exhaust hole 163 which is subsequently capped at 164. A getter may be employed during evacuation to remove residual gases. In small, portable displays of the present invention, faceplate 90 may be sufficiently thin that spacers are fitted to hold faceplate 90 level relative to magnet 60. In larger displays, faceplate 90 can be formed from thicker, self-supporting glass.

Figure 10:
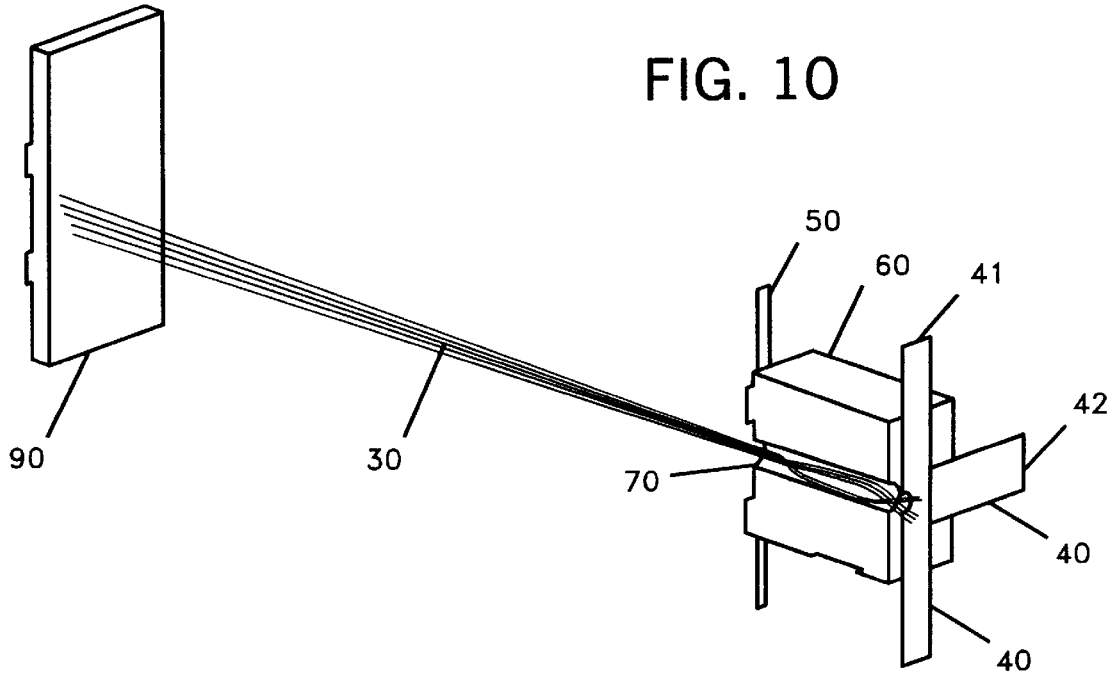
FIG. 10 is an isometric view of an electron source in a display embodying the present invention.

Examples of magnetic matrix displays employing the present invention have been hereinbefore described. Referring to FIG. 10, it will now be appreciated that such displays employ a combination of electrostatic and magnetic fields to control the path of high energy electrons in a vacuum. Such displays have a number of pixels and each is generated by its own site within the display structure. Light output is produced by the incidence of electrons on phosphor stripes. Both monochrome and colour displays are possible. An example of a colour version uses a switched anode technique as hereinbefore described to perform beam indexing.

During assembly of the screen 90 to the magnet 60, the screen and magnet must be rotationally aligned so that the beams leaving the pixel wells arrive at the correct phosphor stripe and do not illuminate adjacent, different coloured phosphor stripes 80. If the screen 90 is not rotationally aligned, the rotation effect causes the beams to arrive at screen 90 at an angle to phosphor stripes 80. This tends to mitigate against acceptable colour purity.

In a preferred embodiment of the present invention, the aforementioned problem of maintaining acceptable colour purity is solved by optical alignment of the screen 90 of a magnetic matrix display to the magnet 60 during final assembly, so that the columns of pixel wells 70 are registered precisely, horizontally and rotationally, to the vertical phosphor stripes 80.

Figure 11:
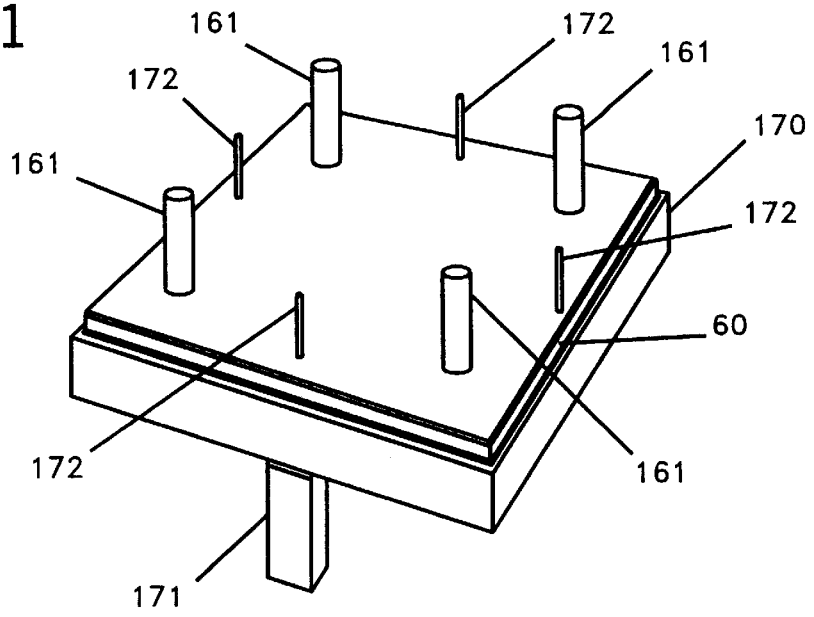
FIG. 11 is an isometric view of a magnet and adjusting fixture embodying the present invention.

Referring to FIG. 11, a collimated light source 171 is used for the step of optical alignment. In the alternative, a laser light source 171 may be used. Both of these are hereinafter referred to collectively as a light source 171. A magnetic matrix display already contains a precise array of pixel wells 70 in the magnet 60, so in a simple embodiment the light source 171 shines light through one or more of the pixel wells 70 to illuminate the phosphor stripes 80 and so allow visual alignment of the matrix of pixel wells 70 with the phosphor stripes 80 with which they are associated.

In a preferred embodiment, an assembly fixture 170 is used in the alignment process. Additional specific alignment holes are formed in the magnet 60, with corresponding alignment phosphor points on the screen 90. Holes are present in the assembly fixture 170, located outside the area of the magnet occupied by the normal array of pixel wells 70. In operation, the light source 171 shines through holes in the base of the assembly fixture 170, through the additional specific alignment holes formed in the magnet and illuminates the alignment phosphor points on the screen 90 of the magnetic matrix display. The screen 90 can then be visually aligned with the magnet 60 by moving it relative to the glass side supports 161 located on the magnet so that the beams 172 from the light source illuminate each of the alignment phosphor points. The alignment may be assisted by the use of magnified camera images. In an alternative embodiment, alignment is completed automatically, using a vision system.

A technique was described above for shifting the electron beam to allow for horizontal misalignment between phosphors 80 and pixel wells 70 by introducing a standing DC potential difference across deflection anodes 51 and 52. The DC potential difference across the deflection anodes is uniform along their length from top to bottom of the display, although it may be dynamically modulated as the row scan proceeds from top to bottom. This technique does not solve the problem of rotational misalignment.

Figure 12:
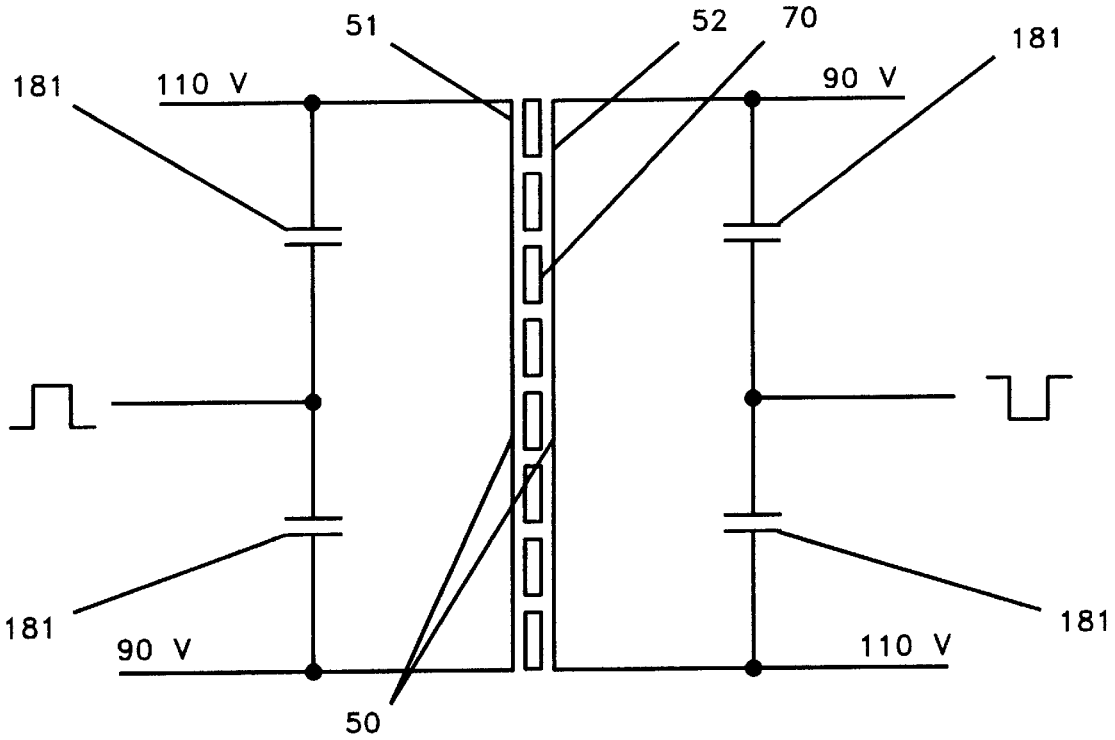
FIG. 12 is a plan view of deflection anodes of a display embodying the present invention.

Referring to FIG. 12, the problem of rotational misalignment of the screen 90 relative to the magnet 60 of a magnetic matrix display may be further solved by making deflection anodes 51 and 52 resistive, together with a differential DC voltage applied across each of the anodes 51 and 52. Resistive anodes 51 and 52 may be used to allow a less precise mechanical registration, rotationally, of the magnet 60 to the phosphor stripes 80. In a preferred embodiment, a mechanical alignment to within ±100 $\mu$m at the final assembly stage is used. The resistive anodes 51 and 52, together with the differential DC voltage are used to achieve an overall alignment within ±10 $\mu$m.

If the differential dc voltage applied along the length of each of the anodes 51 and 52 is zero, then the only net deflection for all of the electron beams in a column is horizontal, due to any standing DC potential difference applied to correct any horizontal misalignment. If a net differential voltage is applied across the length of each of the anodes 51 and 52 and if this is symmetrical and opposite on each of the anodes 51 and 52, then there will be a horizontal shift at the top and an equal and opposite horizontal shift at the bottom. There will be zero shift at the centre of the anodes 51 and 52. These horizontal shifts have the effect of a rotational shift, which may be controlled by a potentiometer controlling the voltages applied to each end of the anodes 51 and 52.

The AC voltage used for beam indexing is applied via capacitors 181 connected to each end of the anodes 51 and 52 so as not to disturb the DC levels used for horizontal and rotational alignment.

A ±20 V differential voltage gives a rotation of ±1 phosphor stripe, which is sufficient to correct for rotational misalignment, especially if the optical alignment techniques described above have been used to provide a coarse rotational alignment.

Typically, the capacitance of one deflection anode strip is approximately 0.17 pF. Allowing a time constant of 0.1 $\mu$S, which will give about 0.3 $\mu$S switching time for a pulse response, then the maximum resistance of each of the anodes 51 and 52 is 588 kΩ. If a maximum differential voltage of 20 V is used, then the power dissipation in each of the anodes is 0.68 mW. For a magnetic matrix display comprising 1024 pairs of anodes 51 and 52, this gives a total dissipation of 1.4 W. If higher voltages and powers are used, then the dissipation will increase and the range of adjustment available will also increase.

Deposition of the resistive tracks used for the anodes 51 and 52 can be simply done in any of a number of ways, such as, for example, photo screen printing or thin layer electroless deposition.

Any problems due to misalignment of the elliptical pixel beam spots with rotationally misaligned phosphor stripes can be compensated by the coil technique as described in U.S. Pat. No. 5,747,903 (Attorney Reference UK9-96-010), the content of which is incorporated herein by reference.

Although an illustrative embodiment and its advantages have been described in detail hereinabove, they have been described as example and not as limitation. Various changes, substitutions and alterations can be made in the illustrative embodiment without departing from the breadth, scope and spirit of the present inventions.

What is claimed is:

1. A display device comprising: cathode means for emitting electrons; a permanent magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating facing the side of the magnet remote from the cathode, the phosphor coating comprising a plurality of pixels each corresponding to a different channel; grid electrode means disposed between the cathode means and the magnet for controlling flow of electrons from the cathode means into each channel; deflection means for sequentially addressing the electron beam from each channel to each pixel of the corresponding group; and rotational alignment means for aligning electron beams from the channels with corresponding pixels of the phosphor coating.

2. A display device as claimed in claim 1, wherein the rotational alignment means comprises a resistive deflection means and means for generating a differential voltage across one or more elements of the deflection means.

3. A display device as claimed in claim 2, wherein the rotational alignment means further comprises means for varying the magnitude and polarity of the differential voltage across one or more elements of the deflection means.

4. A display device as claimed in claim 1, wherein each pixel comprises a plurality of different colour sub-pixels, and wherein the rotational alignment means comprises a plurality of anode means each disposed on the surface of the magnet remote from the cathode, each corresponding to a different channel, and each comprising a first and second anode respectively extending along opposite sides of the corresponding channel for accelerating electrons through the corresponding channel and for sequentially addressing electrons emerging from the corresponding channel to different sub-pixels of the corresponding pixel, the first and second anodes associated with each channel being resistive and having a differential voltage applied across the first anode and across the second anode, the differential voltages being symmetrical and opposite in sense.

5. A display device as claimed in claim 4, wherein a beam indexing voltage is applied to the first and second anodes so as to sequentially address electrons emerging from the channels to different ones of the phosphors for the phosphor coating thereby to produce a colour image on the screen.

6. A display device as claimed in claim 4, wherein the first and second anodes comprise a resistive metal film.

7. A display device as claimed in claim 6, wherein the resistive metal film is deposited by means of photo screen printing.

8. A display device as claimed in claim 6, wherein the resistive metal film is deposited by means of thin layer electroless deposition.

9. A display device as claimed in claim 1, comprising means for dynamically varying a DC level applied to the anode means to align electrons emerging from the channels with the phosphor coating on the screen.

* * * * *